US010753687B2

(12) United States Patent
Plummer et al.

(10) Patent No.: US 10,753,687 B2
(45) Date of Patent: Aug. 25, 2020

(54) HEAT EXCHANGER TUBE

(71) Applicant: Beckett Gas, Inc., North Ridgeville, OH (US)

(72) Inventors: Jacob X. Plummer, North Olmsted, OH (US); Heasam A. Halasa, Amherst, OH (US); Scott Lackie, Brunswick, OH (US)

(73) Assignee: BECKETT GAS, INC., North Ridgeville, OH (US)

( * ) Notice: Subject to any disclaimer, the term of this patent is extended or adjusted under 35 U.S.C. 154(b) by 61 days.

(21) Appl. No.: 16/033,662

(22) Filed: Jul. 12, 2018

(65) Prior Publication Data

US 2019/0017753 A1 Jan. 17, 2019

Related U.S. Application Data

(60) Provisional application No. 62/533,206, filed on Jul. 17, 2017.

(51) Int. Cl.

| | |
|---|---|
| ***F28F 1/20*** | (2006.01) |
| ***F28F 1/06*** | (2006.01) |
| ***F28F 9/24*** | (2006.01) |
| ***F24F 13/30*** | (2006.01) |
| ***F28D 7/08*** | (2006.01) |
| ***F28D 21/00*** | (2006.01) |
| ***F24H 1/20*** | (2006.01) |
| *F28F 1/02* | (2006.01) |
| *F24F 3/044* | (2006.01) |

(52) U.S. Cl.

CPC ..... *F28F 1/06* (2013.01); *F24F 13/30* (2013.01); *F24H 1/205* (2013.01); *F28D 7/087* (2013.01); *F28D 21/0005* (2013.01); *F28F 9/24* (2013.01); *F24D 2220/06* (2013.01); *F24F 3/044* (2013.01); *F24F 2221/34* (2013.01); *F28D 21/0007* (2013.01); *F28D 21/0008* (2013.01); *F28F 2001/027* (2013.01); *F28F 2250/00* (2013.01)

(58) Field of Classification Search

CPC ..... F28F 1/06; F28F 9/24; F28F 3/044; F28F 2221/34; F28F 2001/027; F28F 2250/00; F24H 3/105; F24H 3/065; F24H 1/205; B29C 67/0014; F24F 13/30; F24D 2220/06; F28D 1/05383; F28D 7/106; F28D 7/087; F28D 21/0005; F28D 21/0007; F28D 21/0008

USPC ..... 165/181

See application file for complete search history.

(56) References Cited

U.S. PATENT DOCUMENTS 4,585,059 A * 4/1986 Lee ..... F28D 7/106 138/113
5,271,376 A * 12/1993 Lu ..... F24H 3/105 126/110 R
5,333,598 A * 8/1994 Mielke ..... F24H 3/105 126/116 R (Continued)

*Primary Examiner* — Davis D Hwu

(74) *Attorney, Agent, or Firm* — Tarolli, Sundheim, Covell & Tummino LLP

(57) ABSTRACT

A heat exchanger for an apparatus including a burner has at least one tube extending along a centerline from an inlet end adjacent the burner to an outlet end. A plurality of indentations is formed in the tube adjacent the inlet end and extend radially inward towards the centerline. The indentations are formed in opposing pairs extending towards one another to a depth sufficient to create turbulent fluid flow through the inlet end of the tube.

18 Claims, 7 Drawing Sheets

(56) References Cited

U.S. PATENT DOCUMENTS

| | | | | |
|---|---|---|---|---|
| 5,730,213 | A * | 3/1998 | Kiser | F28D 1/05383 165/109.1 |
| 5,839,505 | A | 11/1998 | Ludwig et al. | |
| 5,979,548 | A * | 11/1999 | Rhodes | B29C 67/0014 165/284 |
| 6,688,378 | B2 | 2/2004 | O'Donnell et al. | |
| 6,945,320 | B2 | 9/2005 | Harvard, Jr. et al. | |
| 7,255,155 | B2 | 8/2007 | O'Donnell et al. | |
| 8,459,342 | B2 | 6/2013 | O'Donnell et al. | |
| 2007/0089873 | A1 | 4/2007 | Beste et al. | |
| 2012/0006512 | A1 | 1/2012 | Guo et al. | |
| 2015/0211751 | A1 * | 7/2015 | Wortman | F24H 3/065 126/91 A |

* cited by examiner

HEAT EXCHANGER TUBE

RELATED APPLICATIONS

This application claims the benefit of U.S. Provisional Application Ser. No. 62/533,206, filed Jul. 17, 2017, the entirety of which is incorporated by reference herein.

TECHNICAL FIELD

The present invention relates generally to heat exchangers and more specifically to heat exchangers that include fluid turbulating indentations for enhancing heat transfer

BACKGROUND

A typical method of making heat exchangers for a variety of gas- and oil-fired industrial or residential products is to bend a metal tube into a serpentine shape, thereby providing multiple passes. Gases heated by a burner at one end of the heat exchanger travel through the tube interior and exit the other end of the heat exchanger. While the hot flue gases are within the tube, heat is conducted through the metal walls of the tube and transferred to the air or other fluid media surrounding the tube, which raises its temperature. In order to achieve efficient heat transfer from the tubes, it is usually necessary to alter the flow of gases by reducing their velocity and/or promoting turbulence, mixing, and improved contact with the tube surface.

SUMMARY

In one example, a heat exchanger for an apparatus including a burner has at least one tube extending along a centerline from an inlet end adjacent the burner to an outlet end. A plurality of indentations is formed in the tube adjacent the inlet end and extends radially inward towards the centerline. The indentations are formed in opposing pairs extending towards one another to a depth sufficient to create turbulent fluid flow through the inlet end of the tube.

In another example, a heat exchanger for an apparatus including a burner has a plurality of serpentine tubes each extending along a centerline from an inlet end adjacent the burner to an outlet end. A plurality of first indentations is formed in the tube adjacent the inlet end and extends radially inward towards the centerline. The indentations are formed in opposing pairs extending towards one another to a first depth sufficient to create turbulent fluid flow through the inlet end of the tube. A plurality of second indentations is formed in the tube downstream of the first indentations. The second indentations are formed in opposing pairs extending radially inward towards the centerline a second depth further than the first depth.

Other objects and advantages and a fuller understanding of the invention will be had from the following detailed description and the accompanying drawings.

DETAILED DESCRIPTION

The present invention relates generally to heat exchangers and more specifically to heat exchangers that include fluid turbulating indentations for enhancing heat transfer. The heat exchangers can be used in, for example, furnaces, HVAC units, water heaters, unit heaters, and commercial ovens.

Figure 1A:
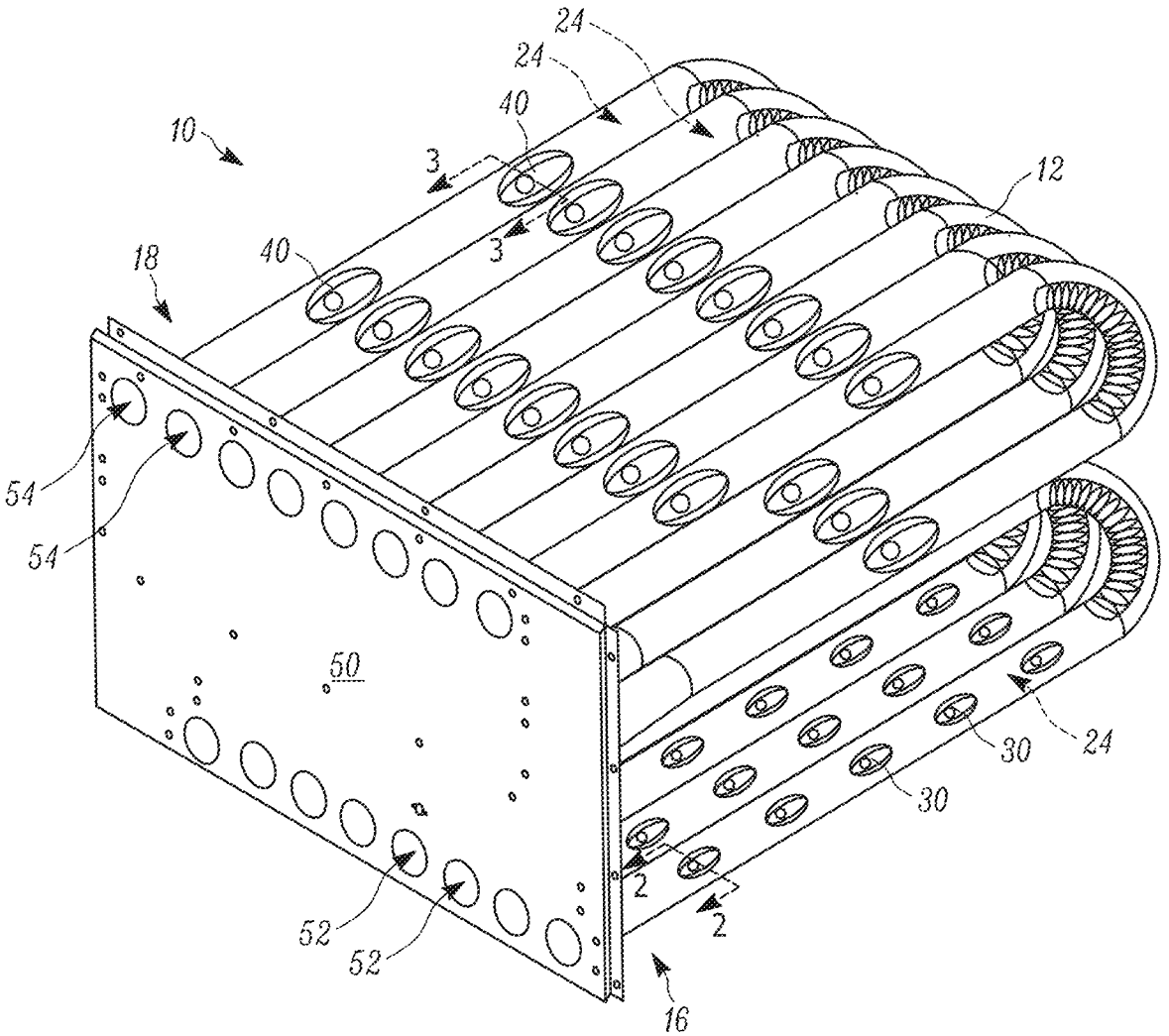
FIG. 1A illustrates an example heat exchanger in accordance with the present invention.

FIGS. 1A-3 illustrate an example heat exchanger 10 in accordance with the invention. Referring to FIGS. 1A-1B, the heat exchanger 10 includes a plurality of serpentine tubes 12. Although eight tubes 12 are shown, the heat exchanger 10 could include more or fewer tubes, including a single tube. The tubes 12 are formed from a durable material, e.g., aluminum, steel or stainless steel.

Each tube 12 extends along a centerline 14 from a first or inlet end 16 to a second or outlet end 18. A passage 24 extends the entire length of the tube 12. The tubes 12 have a circular cross-section but could alternatively have a polygonal cross-section (not shown). Each tube 12 includes a series of straight portions 20 connected end-to-end by curved portions 22. Alternatively, the curved portions 22 can be omitted (not shown). As shown, the straight portions 20 extend parallel to one another although other configurations/arrangements are contemplated.

Figure 2:
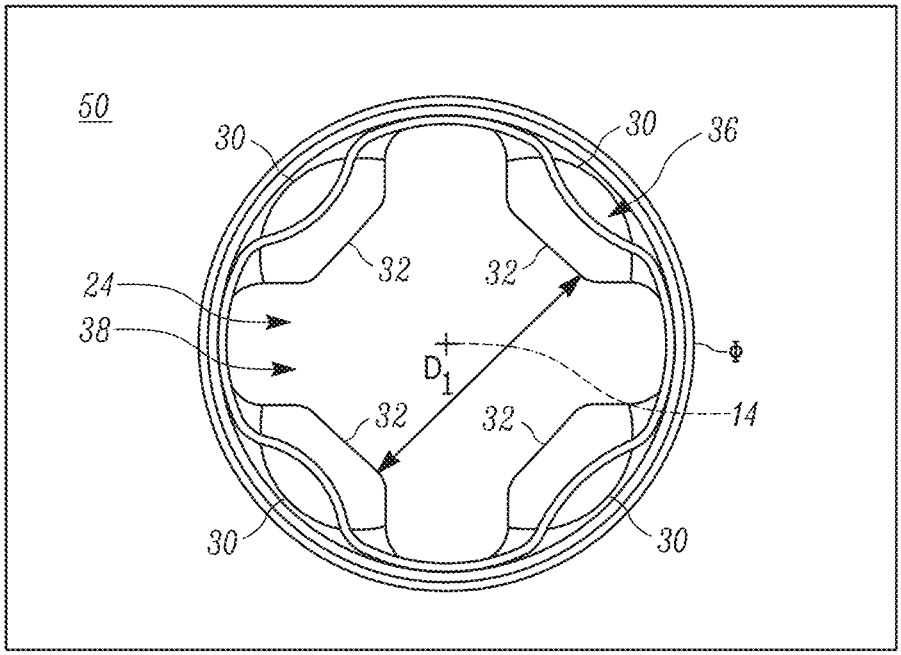
FIG. 2 is a section view of the heat exchanger of FIG. 1A taken along line 2-2.
Figure 3:
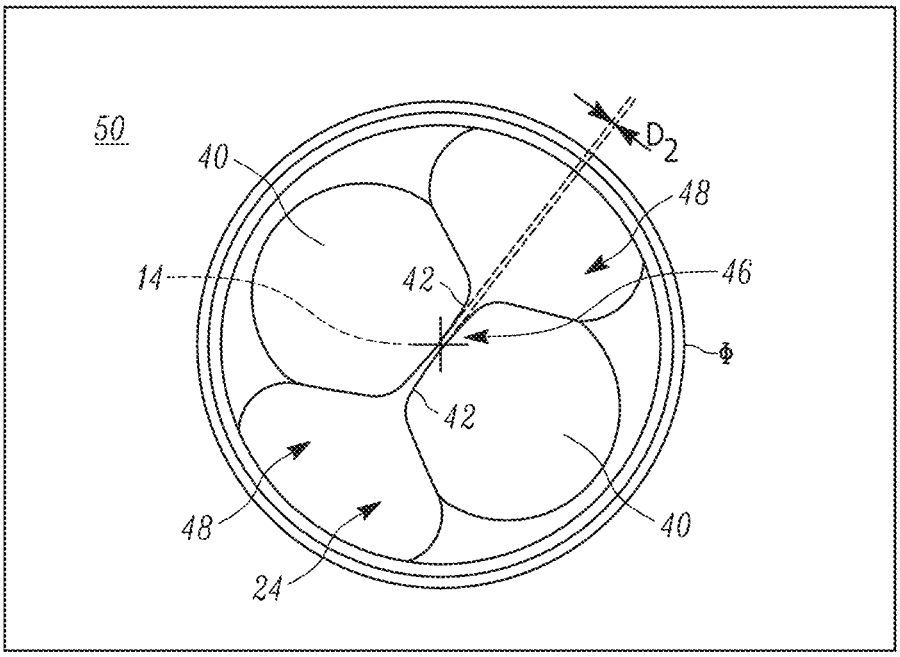
FIG. 3 is a section view of the heat exchanger of FIG. 1A taken along line 3-3.

A series of restricting and turbulating structures are provided or formed in each tube 12. More specifically, indentations 30 is formed at/adjacent the inlet end 16 in the first straight portion 20 of each tube 12. Each indentation 30 has a generally parabolic shape and is pressed into the tube 12 towards the centerline 14. Referring to FIG. 2, the indentations 30 are pressed into the tube 12 in opposing or confronting pairs located across the centerline 14 from one another to collectively form a dimple 36. As shown, four indentations 30 are pressed into the tube 12 at 90° intervals from one another along the circumference of the tube and about the centerline 14. The indentations 30 are located at predetermined positions along the length of the first straight section 20. The circumferential arrangement can be as shown or rotated in the clockwise or counterclockwise direction from what is shown. Other circumferential arrangements for the indentations 30 are contemplated.

Figure 1B:
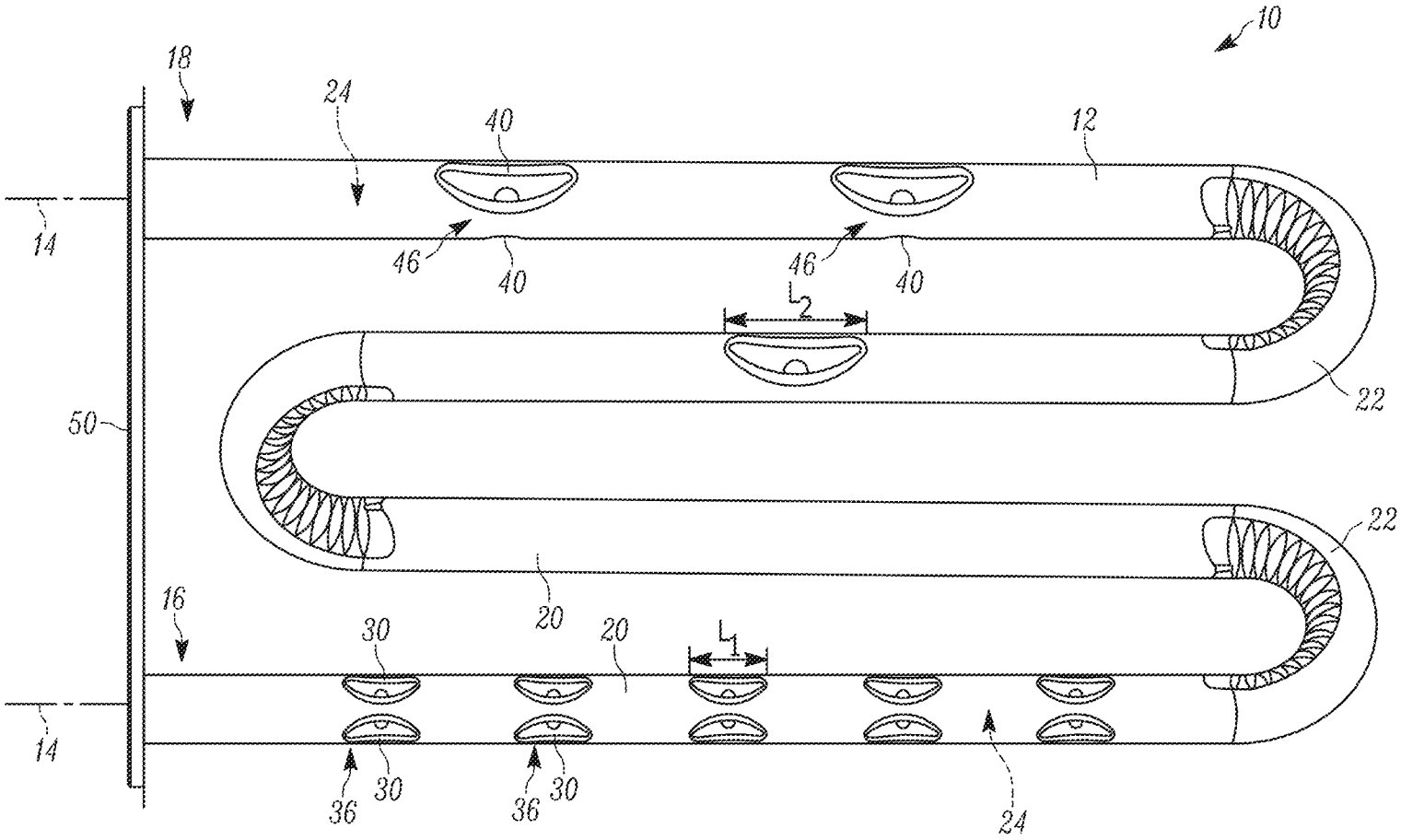
FIG. 1B is a side view of the heat exchanger of FIG. 1A.

The indentations 30 extend radially inward towards one another and towards the centerline 14. As shown in FIG. 1B, each indentation 30 in the respective dimple 36 has the same longitudinal position along the first straight section 20 and, thus, the indentations 30 are symmetrically arranged about the centerline 14 at each longitudinal position. It will be appreciated that any one or more indentations 30 within each dimple 36 can be longitudinally offset from one another or longitudinally aligned with one another. Each indentation 30 has the same length $L_1$ although the indentations 30 can have different lengths within the same dimple 36 and/or between dimples 36.

In any case, the dimples 36 reduce the cross-sectional area of the tube 12 adjacent the inlet end 16 (FIG. 2). The radially innermost surface 32 of each indentation 30 is radially spaced from the opposing innermost surface 32 by a distance $d_1$. The distance $D_1$ can be the same for each opposing pair of indentations 30 or different. Moreover, the distance $D_1$ can vary between dimples 36. In any case, the indentations 30 also cooperate to define a flow passage 38 therebetween with a shape defined by the depth and length $L_1$ of the indentations 30.

The indentations 30 are provided at/near the inlet end 16 of each tube 12 in order to create turbulence in the fluid flow through the tubes. More specifically, the indentations 30 create turbulence in the heated combustion products exiting the burners 80 and flowing through the passages 24. This turbulence helps eliminate laminar flow within the tubes 12 to thereby increase the efficiency of the heat exchanger 10. To this end, the indentations 30—more specifically the radially innermost surfaces 32—are spaced apart the predetermined distance $D_1$ from one another such that the surfaces 32 create turbulence in the heated combustion products without impinging the flame exiting the burners 80.

The number, shape, length, and depth of the indentations 30 can be adjusted to vary the restricting and turbulating characteristics of the first straight section 20 at the inlet end 16 of the tube 12. The ratio of the distance $D_1$ between the indentations 30 to the outer diameter Φ of the tube 12 can be between about 0.55 and about 0.85. In one example, the distance $D_1$ can be 1.25" and the outer diameter Φ can be about 2.25".

In prior heat exchangers, the indentations and dimples are positioned downstream of the first pass and inlet end of the tubes. The dimples of the present invention are advantageous in that they help increase the turbulence of the flame and combustion products at the tube inlets without impinging the actual flame. In other words, the dimples extend deep enough towards the centerline of the tubes to induce turbulence in the flame/combustion products but not so deep as to hinder the flame. Consequently, the ratio range noted above is an example of a dimple construction deep enough to advantageously effect the fluid flow without adversely affecting combustion.

Referring to FIG. 1B, a plurality of indentations 40 is formed along the remaining length of each tube 12, i.e., spaced from the first straight section 20. Each indentation 40 has a generally parabolic shape and is pressed into the tube 12. The indentations 40 are pressed into the tube 12 in opposing or confronting pairs located across the centerline 14 from one another to collectively form a dimple 46 (see also FIG. 3). As shown, two indentations 40 are pressed into the tube 12 180° apart from one another along the circumference of the tube and about the centerline 14. Other circumferential arrangements for the indentations 40 are contemplated. The indentations 40 are located at predetermined positions along the length of the particular straight section 20.

The indentations 40 extend radially inward towards one another and towards the centerline 14. As shown in FIG. 1B, each pair of opposing indentations 40 has the same longitudinal position on the straight section 20 and, thus, the opposing indentations 40 are symmetrically arranged about the centerline 14 at each longitudinal position. It will be appreciated that any one or more indentations 40 can be longitudinally offset from any other indentation 30 within the same dimple 46. Each indentation 40 has the same length $L_2$ although the indentations 40 can have different lengths.

In any case, the dimples 46 reduce the cross-sectional area of the tube 12 downstream of the inlet end 16. The innermost surface 42 of each indentation 40 is radially spaced from the opposing innermost surface 42 by a distance $d_2$. The distance $D_2$ can be the same for each opposing pair of indentations 40 or different. Moreover, the distance $D_2$ can vary between dimples 46. Each indentation 40 may confront the opposing indentation 40 without contact (FIG. 3) or contact the indentation opposite it, e.g., the distance $D_2$ is zero. In both cases, the distance $D_2$ is configured to result in a significant reduction of the cross-sectional area of the tube 12. The distance $D_2$ can be up to about 12% of the tube outer diameter Φ.

In any case, the indentations 40 form a pair of adjacent, converging/diverging nozzles in the tube 12 to enhance heat transfer through the tube wall by disrupting the fluid boundary layer at the tube inner surface. The expanding fluid streams exiting the nozzle interact to produce turbulence downstream even at low Reynolds flow numbers (low flow velocities). An aperture 48 of adjoining nozzle is controlled by the depth of the confronting indentations 40. Controlling the aperture 48 of the nozzles allows precise control of the pressure drop through the tube 12 and the flow characteristics as necessary to conform to the design of the tube, i.e. the number of serpentine passes and length of each pass, and the product in which the tube will be implemented.

When the indentations 40 do not contact one another, the space between the indentations 40 remains a dead flow area within a range of spacing between about 0-12% of the tube outer diameter Φ. This allows for the control of the flow and pressure drop characteristics of the nozzles by controlling the size of the single aperture 48. The size of the aperture(s) 48 can be selected by varying the depth of the indentations 40, allowing the use of a single tool form design for each tube outer diameter and aperture size Φ. This permits optimization of the tube 12 for heat transfer and efficiency. That said, the number, shape, length, and depth of the indentations 40 be adjusted to vary the restricting and turbulating characteristics of the remaining straight sections 20 of the tube 12.

Figure 1C:
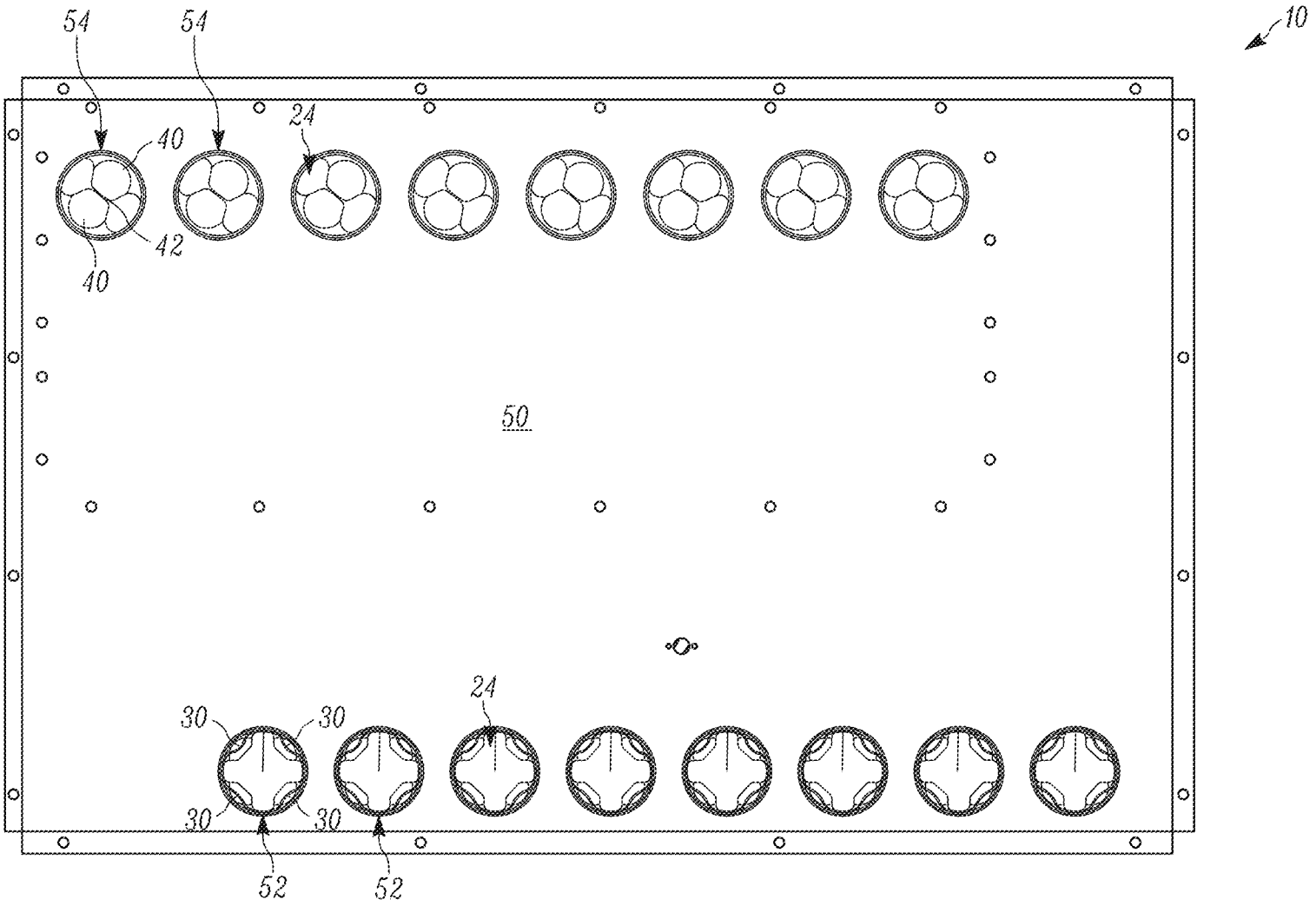
FIG. 1C is a front view of the heat exchanger of FIG. 1A.

Referring to FIGS. 1A and 1C, the heat exchanger 10 further includes a panel 50 connected to each tube 12. The panel 50 includes openings 52 for receiving the inlet ends 16 of the tubes 12, and, thus, the number of openings 52 corresponds to the number of inlet ends. Similarly, the panel 50 includes openings 54 for receiving the outlet ends 18 of the tubes 12 and, thus, the number of openings 54 corresponds to the number of outlet ends. The openings 52, 54 are arranged to position the tubes 12 in a predetermined manner, e.g., with the inlet ends 16 arranged in a row and the outlet ends 18 arranged in a row. The passages 24 in the tubes 12 are aligned with the openings 52, 54. Both ends 16, 18 of the tubes 12 are connected to the panel 50 in a fluid-tight manner around the openings 52, 54.

Figure 4:
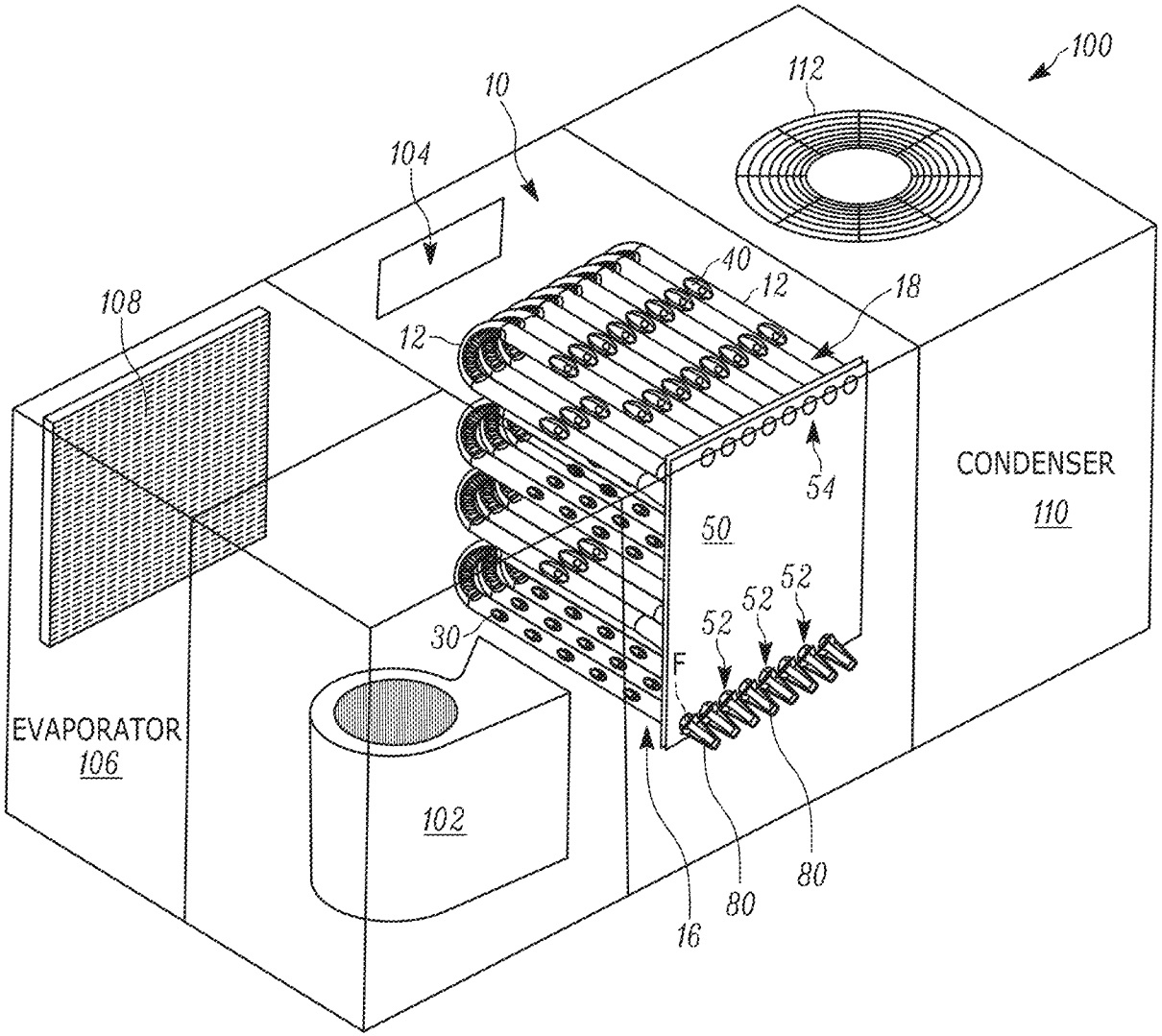
FIG. 4 is a schematic illustration of an HVAC unit including the heat exchanger of FIG. 1.

FIG. 4 shows an example HVAC unit 100 including a modified version of the heat exchanger 10 having eight tubes 12 each having eight passes. More or fewer tubes 12 with more or fewer passes can be used. The HVAC unit 100 further includes an evaporator 106 including evaporator coils 108 and a condenser 110 having a fan 112. A duct 104 directs heated or cooled air away from the HVAC unit 100 to the space to be heated/cooled.

The panel 50 is secured to the HVAC unit 100 between the evaporator 106 and the condenser 110 with the tubes 12 secured to the panel. An in shot burner 80 is aligned with each opening 52 and corresponding inlet end 16 of each tube 12. The in shot burners 80, when lit, direct a flame F into each inlet end 16 and thereby into each passage 24.

When the HVAC unit 100 is used as a furnace, the burners 80 ignite and heat gases, which pass through the eight passes of the serpentine shaped tubes 12. Heat is conducted from each passage 24, through the tube wall 12, and radiates outward to the space surrounding the tubes, i.e., into the interior of the HVAC unit 100. A fan 102 blows air across the tubes 12 where it is heated and ultimately exits the HVAC unit 100 via the duct 104.

The dimples 36, 46 act to induce turbulence in the heated gas as it flows through the passages 24 to thereby improve mixing and efficiency in the heat exchanger 10. More specifically, the dimples 36 at the inlet end 16 of the tubes 12 induce turbulence along the entire first pass of each tube, i.e., between the burner 80 and the first curved portion 22. It is believed that the temperature of the tube 12 wall is increased not only by the induced turbulence but also by simply being closer to the heat source.

When the HVAC unit 100 is used as an air conditioner, the burners 80 are not lit. Instead, refrigerant is vaporized in the evaporator 106, causing the coils 108 to become cold. The fan 102 draws air across the evaporator coils 108 where it is cooled while moving across the tubes 12 prior to moving out of the HVAC unit 100 via the duct 104. The refrigerant is then moved to the condenser 110 where it returns to liquid form.

Figure 5:
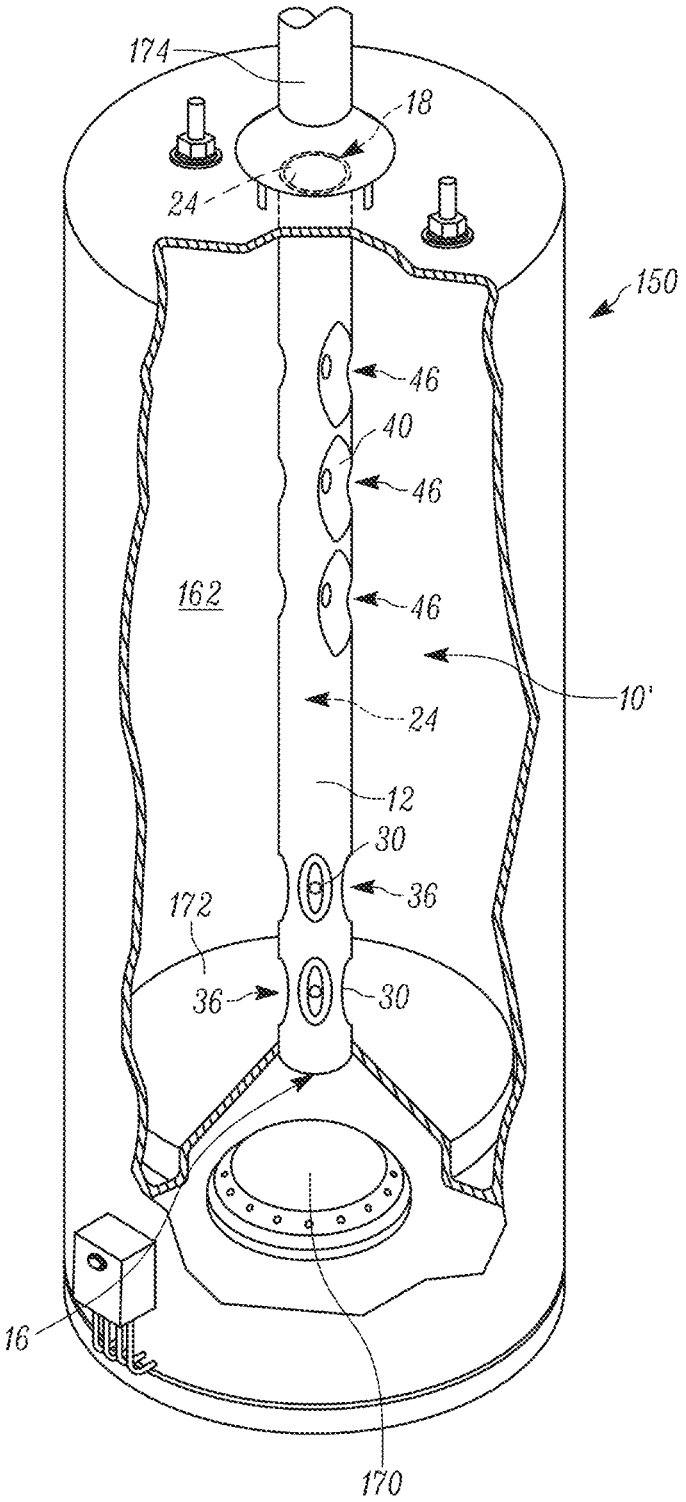
FIG. 5 is a schematic illustration of a residential water heater including another example heat exchanger of the present invention.

FIG. 5 illustrates an example residential water heater 150 including a heat exchanger 10' with a single tube 12 and no curved portions. The water heater 150 defines a water heating chamber 162 filled with water (not shown) and includes a gas burner 170 at one end and a vent system 174 at the other. The single tube 12 is positioned within the water heating chamber 162 such that the inlet end 16 is aligned with and positioned adjacent to the gas burner 170. The outlet end 18 is aligned with and positioned adjacent the vent system 174.

In operation, the gas burner 170 heats gases that move through the tube 12 in an upward direction from the inlet end 16 to the outlet end 18. The gases are ultimately exhausted through the outlet end 18 and into the water heater vent system 174. The heat from these gases is conducted through the walls of the tube 12 to heat the water in the surrounding water heating chamber 162.

The dimples 36, 46 act to induce turbulence in the heated gas as it flows through the passages 24 to thereby improve mixing and efficiency in the heat exchanger 10'. More specifically, the dimples 36 at the inlet end 16 of the tubes 12 induce turbulence along the entire first pass of each tube, i.e., between the burner 80 and the first curved portion 22. It is believed that the temperature of the tube 12 wall is increased not only by the induced turbulence but also by simply being closer to the heat source.

Figure 6:
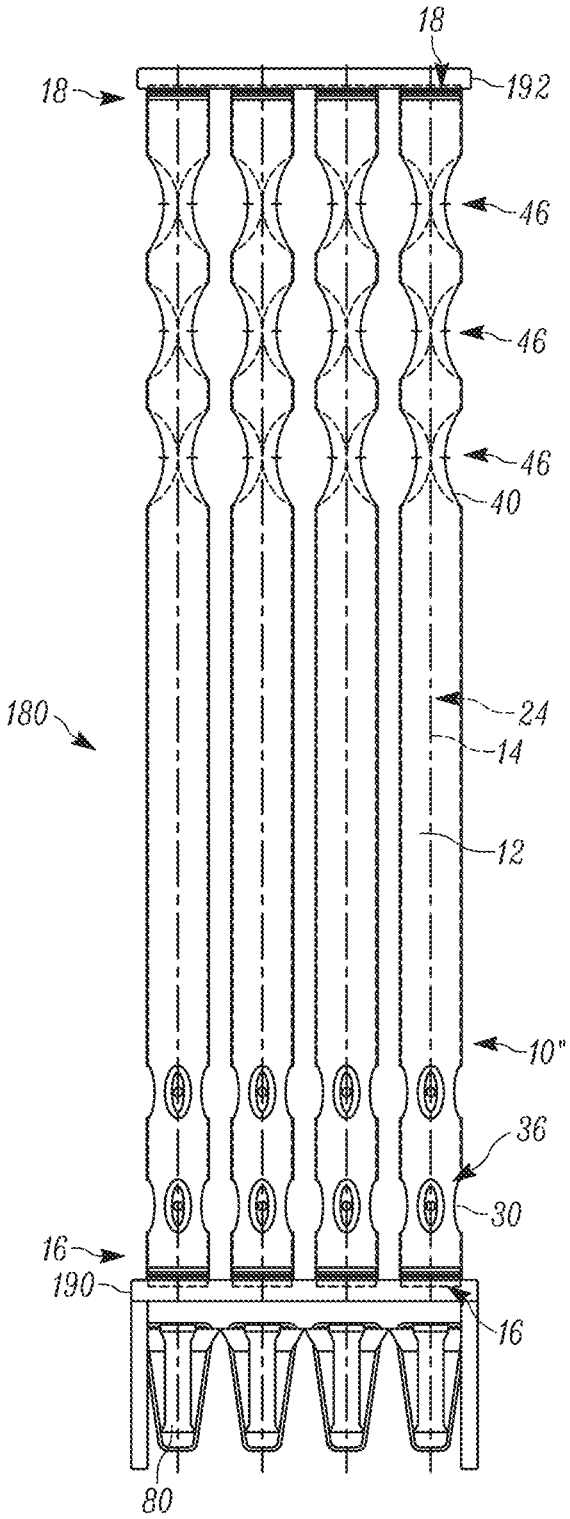
FIG. 6 is a schematic illustration of tube set including another example heat exchanger of the present invention.
Figure 7:
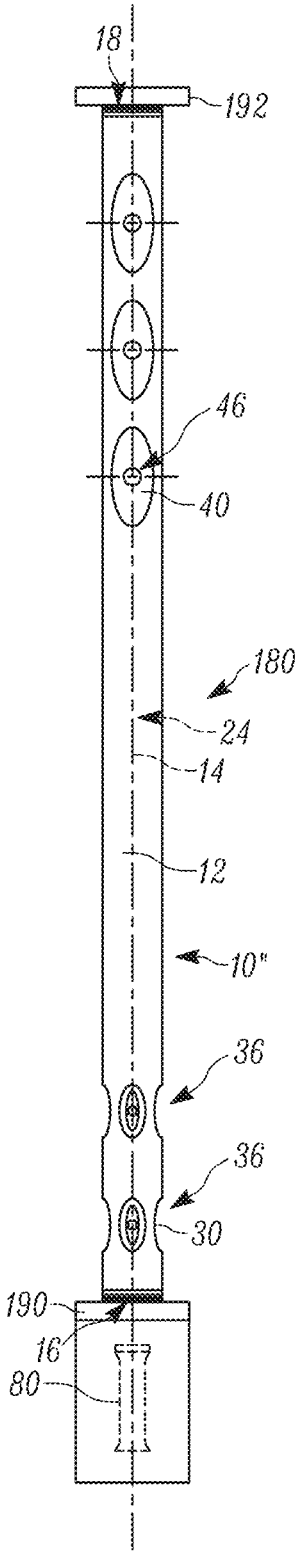
FIG. 7 is a side view of the tube set of FIG. 6.

FIGS. 6-7 illustrate an example heat exchanger tube set 180 for use in a vertical gravity type gas wall furnace. The tube set 180 includes a heat exchanger 10" having four straight tubes 12, i.e., tubes without curved portions. The inlet ends 16 are connected to a header plate 190. Four gas burners 80 are connected to the header plate 190 so as to be aligned with the inlet ends 16 and passages 24 associated therewith for directing flames into the passages. The outlet ends 18 of the tubes 12 are connected to an outlet bracket 192 where the heated gases are exhausted.

As with the heat exchangers 10, 10', the dimples 36 in the heat exchanger 10" are located adjacent the inlet end 16 of each tube 12. The dimples 40 are located downstream of the dimples 36. The dimples 36, 46 act to induce turbulence in the heated gas as it flows through the passages 24 to thereby improve mixing and efficiency in the heat exchanger 10" without hindering the flames F from the burners 80.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A heat exchanger for an apparatus including a burner, comprising:

at least one tube extending along a centerline from an inlet end adjacent the burner to an outlet end; and a plurality of indentations formed in the tube adjacent the inlet end and extending radially inward towards the centerline, the cross-sectional shape of the tube being constant from an opening at the inlet end to the first of the plurality of indentations, the indentations being formed in opposing pairs extending towards one another to a depth sufficient to create turbulent fluid flow through the inlet end of the tube without impinging on a burner flame extending between the indentations.

2. The heat exchanger recited in claim 1, wherein a ratio of the depth of the indentations to an outer diameter of the tube is about 0.55 to about 0.85.

3. The heat exchanger recited in claim 1, wherein two pairs of opposing indentations cooperate to form at least one dimple.

4. The heat exchanger recited in claim 3, wherein no indentations in any one dimple engage one another.

5. The heat exchanger recited in claim 3, wherein the indentations of the same dimple have the same longitudinal position along the tube.

6. The heat exchanger recited in claim 3, wherein no indentations intersect the centerline of the tube.

7. The heat exchanger recited in claim 1, wherein the indentations comprise first indentations and the at least one tube further includes second indentations formed in opposing pairs extending radially inward towards the centerline to a depth further than the first indentations adjacent the inlet end extend.

8. The heat exchanger recited in claim 7, wherein the second indentations engage one another at the centerline of the tube.

9. The heat exchanger recited in claim 1, wherein each tube is a serpentine tube.

10. An HVAC unit including the heat exchanger of claim 1, wherein the at least one tube comprises a plurality of serpentine tubes.

11. A water heater including the heat exchanger of claim 1.

12. A tube set including the heat exchanger of claim 1, wherein the at least one tube includes a plurality of straight tubes.

13. The heat exchanger recited in claim 1, wherein the inlet end is free of dimples upstream of the plurality of indentations.

14. A heat exchanger for an apparatus including a burner, comprising:

at least one serpentine tube each extending along a centerline from an inlet end adjacent the burner to an outlet end;

a plurality of indentations formed in the tube adjacent the inlet end and extending radially inward towards the centerline, the indentations being formed in opposing pairs extending towards one another to a first depth sufficient to create turbulent fluid flow through the inlet end of the tube, and a plurality of second indentations formed in the tube downstream of the indentations, the second indentations being formed in opposing pairs extending radially inward towards the centerline a second depth further than the first depth.

15. The heat exchanger recited in claim 14, wherein the second indentations engage one another at the centerline of the tube.

16. The heat exchanger recited in claim 14, wherein the second indentations are different from the indentations adjacent the inlet end.

17. The heat exchanger recited in claim 14, wherein a ratio of the first depth to an outer diameter of the tube is about 0.55 to about 0.85.

18. The heat exchanger recited in claim 14, wherein no indentations intersect the centerline of the tube.

* * * * *